United States Patent [19]

Geberth, Jr.

[11] Patent Number: 4,457,472

[45] Date of Patent: Jul. 3, 1984

[54] EXTENDABLE SPRAY GUN

[76] Inventor: John D. Geberth, Jr., 10 Goose Cove La., Ramsey, N.J. 07446

[21] Appl. No.: 439,903

[22] Filed: Nov. 8, 1982

[51] Int. Cl.[3] ..... B05B 15/08

[52] U.S. Cl. ..... 239/532; 239/281; 239/578

[58] Field of Search ..... 239/195, 532, 196, 197, 239/198, 281, 578; 248/330.1

[56] References Cited

U.S. PATENT DOCUMENTS

| | | | |
|---|---|---|---|
| D. 234,345 | 4/1975 | Davis | D33/17 |
| 1,745,972 | 2/1930 | Beck | 239/532 |
| 2,792,260 | 12/1956 | Wood | 239/526 |
| 3,915,382 | 10/1975 | Davis | 239/195 |
| 4,013,225 | 3/1977 | Davis | 239/195 |

*Primary Examiner*—John J. Love
*Assistant Examiner*—K. P. Weldon
*Attorney, Agent, or Firm*—Collard, Roe & Galgano

[57] ABSTRACT

An extendable spray gun is provided for hydraulically atomizing and spraying liquids such as paint. A paint spray device is detachably mounted to one end of a telescopically extendable pole while the operation thereof is remotely controlled or actuated by a triggering mechanism located at the other end of the pole where a handle is provided. The triggering mechanism includes means which automatically compensates for changes in pole length so that positive and direct actuation of the spray device by the triggering mechanism is unaffected.

16 Claims, 5 Drawing Figures

EXTENDABLE SPRAY GUN

The present invention relates generally to spray guns and like devices which are adapted to atomize and spray liquids such as paint. More particularly, the present invention relates to such a spray gun wherein the spray head or spray device is mounted on a telescopically extendable pole so that the gun can be utilized in the paint spraying of elevated, out of reach places.

One of the difficulties encountered in painting is the restriction that the painter can only paint those surfaces which he can reach physically. Thus, the painting of elevated structures such as building exteriors, rooms with high ceilings, etc. presents problems for the painter. With the use of ladders and scaffolds, such elevated surfaces are made more accessible to the painter's reach. However, such devices are awkward and cumbersome and involve the expenditure of a sizeable amount of effort and time to utilize. Thus, other means have been sought to facilitate painting such out of reach surfaces so that the use of ladders and scaffolds could be minimized. To this end, poles having painting brushes or rollers mounted to the ends thereof have been utilized extensively to extend the physical reach of painters. In addition, since applying paint by means of spraying has become widely accepted, attempts to utilize poles in connection with spray guns have been made. Thus, in U.S. Pat. Nos. 3,915,382 and 4,013,225, to J. C. Davis, granted Oct. 28, 1975 and Mar. 22, 1977 respectively, there is described an extension spray gun wherein a spray nozzle or tip adapted for hydraulically atomizing and spraying liquids such as paint is mounted at one end of a telescopically adjustable pole and is connected by means of a flexible hose to a spray control valve. The spray control valve is described or shown in these patents to be attached to the other end of the telescopically adjustable pole so that the operator can conveniently operate the control valve and direct the spray of paint which exits from the spray nozzle. In the second identified patent, that bearing U.S. Pat. No. 4,013,225, a spring biased valve is associated with the spray nozzle located at the top of the extendable pole which is adapted to open when the pressure of the paint reaches a predetermined setting thus permitting the paint to flow to the nozzle and to close and stop the flow of paint to the nozzle when the pressure falls below the predetermined pressure. In this manner, if the predetermined pressure is set high enough, there will be no spitting or incomplete atomization of the paint when the operator shuts off the control valve, due to relaxation of the flexible hose between the control valve and the spray nozzle. Thus, it is claimed that an unsightly finish is avoided when the operator shuts off the control valve or ceases the painting operation.

The extension spray gun of the first identified patent, that being U.S. Pat. No. 3,915,382, is identical to that of the second patent above described without the pressure controlled shut-off valve at the spray nozzle. Lacking such a shut-off valve obviously makes such a device less desirable for painting since each time the operator ceases spraying, the paint remaining in the flexible hose, upon construction due to paint pressure loss, will exit the spray nozzle unatomized. This unatomized paint will strike the painting surface in a stream or in drops resulting in an unsightly and imperfect finish.

The object of the present invention is to provide an extendable spray gun, adapted for hydraulically atomizing and spraying liquids such as paint, for the spray painting of out-of-reach surfaces, wherein the triggering mechanism, located in the handle portion of a telescoping pole directly and positively operates the spray device located in the spray head of the telescoping pole, and such direct and positive operation is unaffected by changes in the length of the extendable spray gun.

This object, as well as others which will hereinafter become apparent, is accomplished in accordance with the present invention by the provision of a spray head, including a control valve adapted to hydraulically atomize and spray liquids such as paint, detachably mounted to one end of a telescopically adjustable pole which is provided with a handle and trigger at the other end. The control valve includes a spray opening and a normally closed valve stem moveable in a valve bore which is substantially transverse to and adjacent the spray opening so that the valve stem forms part of and defines the extent of the spray opening. The trigger, through a compensating mechanism and an operating cable attached to an appropriate linkage at the spray head, operates the normally closed valve stem to open and close the spray opening. The compensating mechanism compensates for changes in length of the telescoping pole without affecting the direct operation of the trigger or the spray operation.

The present invention will be described and understood more readily when considered together with the accompanying drawings, in which.

Figure 1:
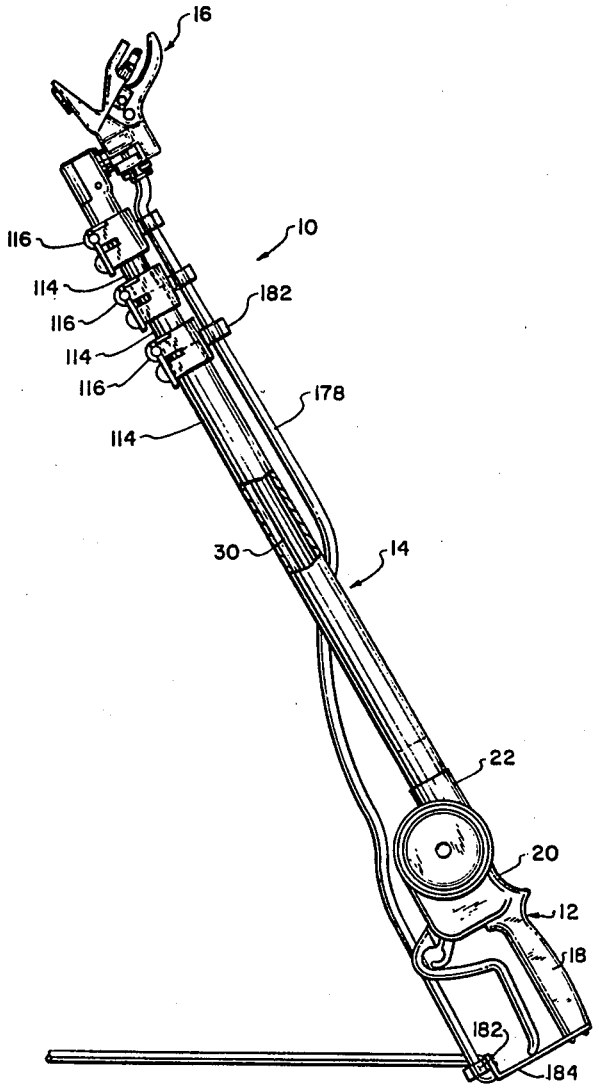
FIG. 1 is a side elevational view of the extendable spray gun of the present invention.

Referring now to the drawings, there is shown in FIG. 1 an extendable spray gun, designated 10, basically comprising a handle portion, designated 12, a telescoping pole, designated 14, and a spray head portion, designated 16.

Figure 2:
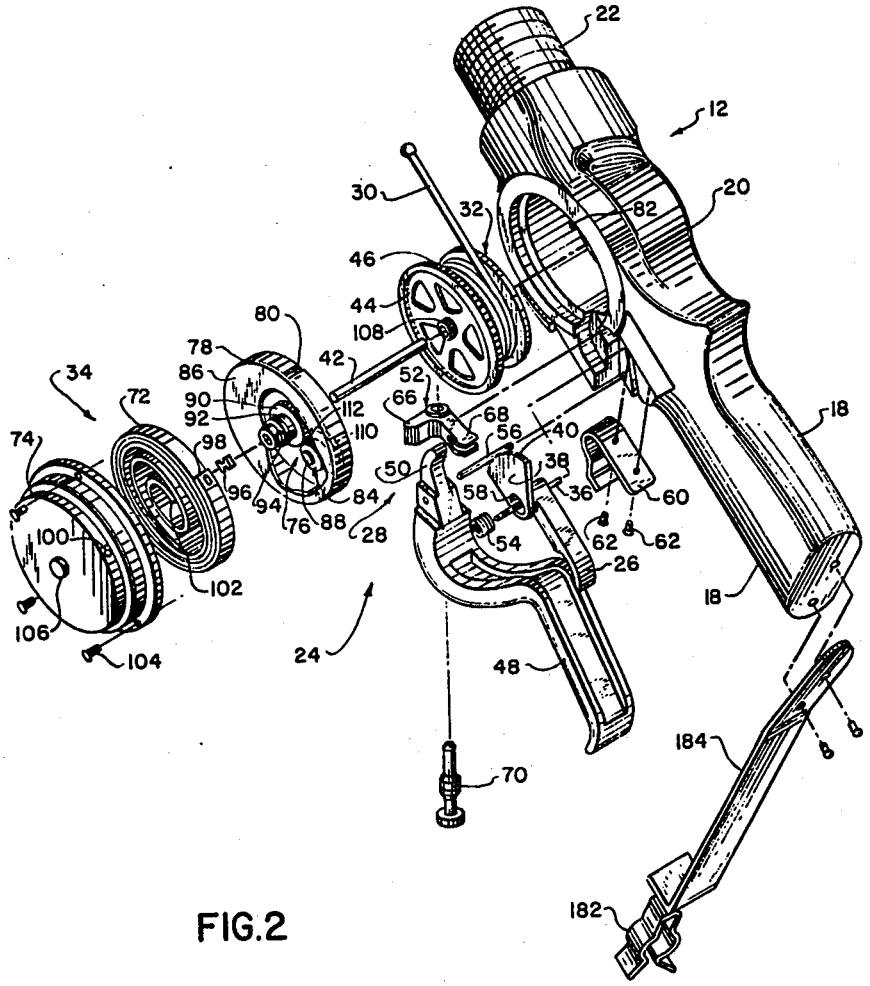
FIG. 2 is an exploded perspective view of the handle portion of the extendable spray gun of FIG. 1 showing the triggering mechanism therefor.
Figure 3:
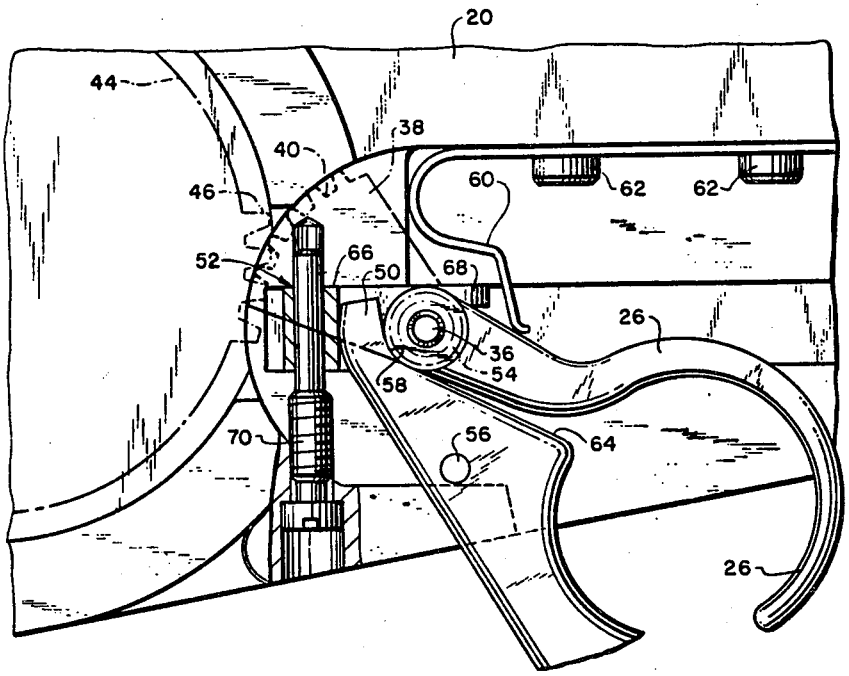
FIG. 3 is an enlarged side elevational view, partly in cross-section, of part of the handle portion of the extendable spray gun of the present invention.

Handle portion 12, as clearly seen in FIGS. 1 and 2, includes a handle, designated 18, a triggering mechanism housing, designated 20, and a pole coupling, designated 22. Handle 18 is designed to permit the operator of the spray gun to hold and operate the spray gun. Housing 20 of the handle portion houses the triggering mechanism, generally designated 24, as clearly seen in FIGS. 2 and 3. Triggering mechanism 24 basically comprises a trigger, designated 26, a trigger activator, designated 28, an operating cable, designated 30, a cable spool, designated 32, and an operating cable length compensating mechanism, designated 34. Trigger 26 is slideably pivotally mounted to housing 20 by means of pivot retaining pin 36. Such mounting permits both a sliding movement of trigger 26 on pivot pin 36 as well as a pivoting of the trigger thereabout. Attached to the trigger 26 at pin 36 is pinion gear segment 38 having gear teeth 40 thereon. Pinion gear segment 38 is fixedly attached to the trigger or may be formed as part thereof such that movement of trigger 26 about pin 36 imparts a corresponding movement, because of the lever action, to the pinion gear segment. Cable spool 32, which takes up the excess of operating cable 30, rotates about retaining axle pin 42 and has a spur gear 44 attached thereto having gear teeth 46 thereon. Operating movement is imparted to operating cable 30 by the triggering of trigger 26 by means of engagement of gear teeth 40 of pinion gear segment 38 with gear teeth 46 of spur gear 44.

Trigger activator 28 includes a handle lever, designated 48, a lever arm, designated 50, a pivot lever, designated 52, and a trigger biasing spring, designated 54. Handle lever 48, which also serves as a trigger guard, is pivotally mounted to housing 20 by means of pivot retaining pin 56 so that a movement imparted to the handle lever, for example by an operator grasping the handle 18 of handle portion 12, results in a corresponding movement in lever arm 50 which is joined to the handle lever at pivot pin 56. Trigger biasing spring 54 is received in a closed bore, designated 58, of trigger 26 and may conveniently be positioned axially about pin 36. Spring 54 normally biases trigger 26, which slideably moves on pin 36, such that pinion gear segment 38 is normally out of engagement with spur gear 44 of cable spool 32. While trigger 26 is in this normally biased position, a leaf spring, designated 60, which is secured to housing 20 by means of screws 62, biases the trigger against a stop, designated 64, which may be formed as part of the trigger guard portion of handle lever 48, as clearly seen in FIG. 3. Pivot lever 52 is basically formed having a right angled shape having arms 66 and 68 and is pivotally mounted at its apex to housing 20 by means of pivot 70. Lever arm 50, pivot lever 52 and trigger 26 are so arranged that arm 50 is adjacent to arm 66 of pivot lever 52 and acts as a cam when movement is imparted thereto by handle lever 48. This cam action of lever arm 50 against arm 66 is translated into a movement of arm 68 against trigger 26. Thus, trigger 26 is moved at a right angle to the initial movement imparted to handle lever 48 to overcome the biasing action of spring 54 resulting in engagement of pinion gear segment 38 with spur gear 44. The purpose of this arrangement is to provide a means of disengageing the trigger 26 from operating engagement when the operator removes his grasp from the handle 18 of the spray gun.

Operating cable length compensating mechanism 34 includes a windup spring, designated 72, a windup spring housing, designated 74, a gear train designated 76, and a gear train housing, designated 78. Gear train housing 78 may be attached to triggering mechanism housing 20 to prevent rotation by any suitable means such as mating the key slot 80 on housing 78 with key 82 in housing 20. Gear train 76, which is a standard reduction gear train, includes an idler gear 84 mounted for rotational movement to face 86 of housing 78 by means of retaining pin 88 and a spur gear 90 fixedly mounted to one end of shaft 92. The other end of shaft 92, which passes through and is retained for rotational movement in face 86, has fixedly attached thereto a spring hook, designated 94. Shaft 92 is axially mounted for rotational movement on axle pin 42. Windup spring 72 is attached to and retained in housing 74 by means of spring retainer 96 which attaches the outer end 98 of spring 72 to an inner circumferential wall of housing 74 at retainer opening 100 therein. The inner end 102 of spring 72 is adapted to engage with spring hook 94 when the triggering mechanism 24 is fully assembled. Housing 74 is fixedly attached to housing 20 by any suitable means such as attaching screws 104 and is provided with a centrally located cap 106 for retaining an end of retaining axle pin 42 while the other end of pin 42 is retained within housing 20.

Gear train 76 is interconnected with and driven by spur gear 44 by means of pinion gear 108 which is fixedly attached to spur gear 44 for axial rotation on axle pin 42. Thus, pinion gear 108 engages with spur gear 110 of idler gear 84 which drives pinion gear 112 which in turn drives spur gear 90. Thus, the rotational movement of the spring hook 94 is reduced from that of the cable spool 32 as the operating cable 30 is withdrawn and spring 72 is wound up placing the operating cable under tension. The effect of the gear reduction is to permit the use of a smaller windup spring.

Telescopic pole 14 is comprised of a plurability of hollow pole sections, generally designated 114, which are adapted to telescope into each other thereby permitting the lengthening and shortening of pole 14 as desired. The pole sections are joined to each other by means of pole clamps 116 which, when tightened, secure the relative positioning of the pole sections 114 to each other. Telescopic pole 14 may be secured to handle portion 12 and coupling 22 by any suitable means such as threadable connection, clamping, etc. Conveniently, operating cable 30 is directed through the hollow pole sections for the length of pole 14 to engage the operating mechanism in spray head portion 16.

Figure 4:
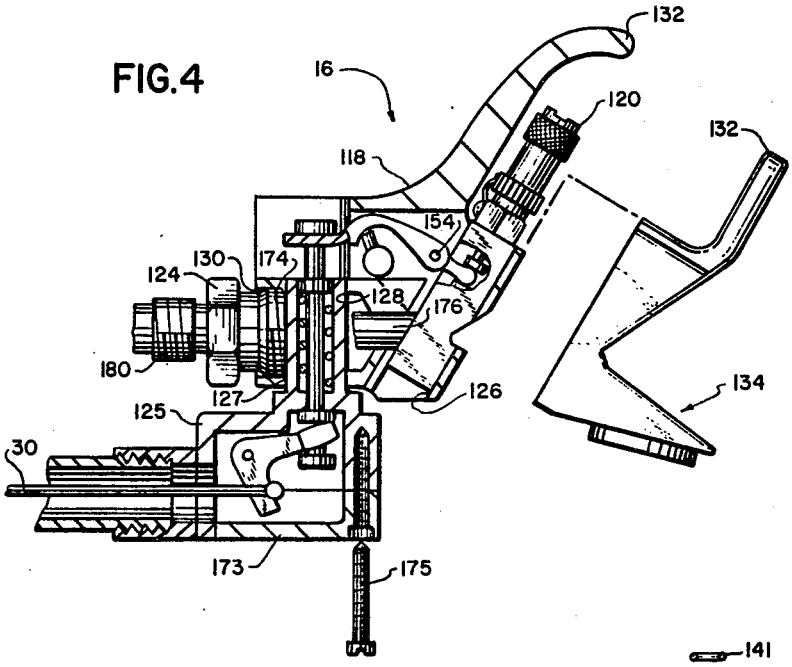
FIG. 4 is an enlarged side elevational view, partly in cross-section, of the spray head portion of the extendable spray gun shown in FIG. 1.
Figure 5:
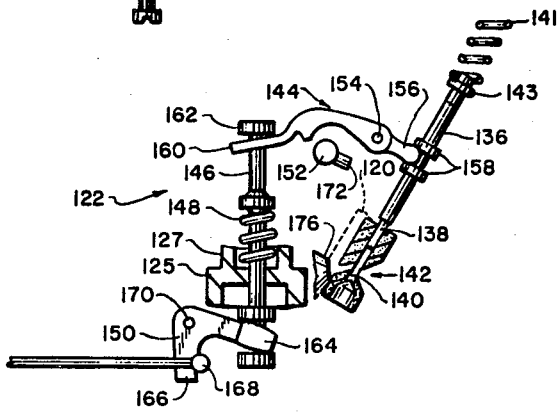
FIG. 5 is an enlarged view of a part of the spray head portion shown in FIG. 4 showing the operating linkage for the control valve thereof.

As clearly seen in FIGS. 4 and 5, spray head portion 16 includes a spray head housing, designated 118, a control valve, designated 120, a control valve operating linkage, designated 122, a fluid connector, designated 124, and a pole coupling, designated 125. Spray head housing 118 includes a bore, designated 126, for accepting control valve 120, an axially clampable bore, designated 128, offset from bore 126 for detachably mounting housing 118 onto pole coupling 125, and a fluid connector bore, designated 130, for accepting fluid connector 124, that intersects with control valve bore 126. Spray head housing 118 may also be provided with protuberances, designated 132, for protecting control valve 120 and a guard, designated 134, for the purpose of avoiding the accidental injecting of the high pressure paint into the skin of an operator or on-looker. Pole coupling 125, which houses most of the components of control valve operating linkage 122, is provided with a tube like connecting shaft, designated 127, onto which housing 118 may be removeably mounted for rotatation by means of bore 128. Pole coupling 125 may be provided with any suitable device which permits attachment to telescopic pole 14, such as a threaded collar (as shown), a clamp, etc.

Control valve 120, which is preferably that as described in my co-pending application Ser. No. 254,376, filed Apr. 15, 1981, Pat. No. 4,389,017 comprises a valve stem assembly designated 136, having a valve stem 138 moveable within a valve bore 140 which is substantially transverse to and adjacent the spray opening 142 in the control valve so that the valve stem forms part of and defines the extent of the spray opening. A valve spring, designated 141, is provided in control valve 120 to bias valve stem 138 to a normally closed position. Valve spring 141 is retained in contact with valve stem assembly 136 by means of spring retainer 143. The operating linkage 122 for control valve 120 comprises an actuating lever, designated 144, an operating rod, designated 146, an actuaing lever biasing spring, designated 148, a pivot lever, designated 150, and a safety stop, designated 152. Actuating lever 144 is pivotally mounted by removeable pivot pin 154 to housing 118 so that one arm of lever 144, the actuating arm, designated 156, engages valve stem assembly 136 between stops 158 to thereby move valve stem 138 in valve bore 140. The other or operating arm, designated 160, of actuating lever 144 is engaged by a stop 162 on operating rod 146 while the other end of operating rod 146 is engaged by an arm 164 of pivot lever 150. Pivot lever 150 is essentially right angled in shape having arm 164 engaging operating rod 146 as mentioned, and arm 166 being engaged by a ball or similar device, designated 168, provided at the end of operating cable 30. Pivot lever 150 is pivotally mounted at its apex 170 to housing 118. Thus, an axial movement of operating cable 30 toward handle portion 12 of the spray gun will result in a retracting movement of valve stem assembly 136 against the biasing action of valve spring 141 and an opening of spray opening 142 by valve stem 138. Actuating lever biasing spring 148 serves to counter the tension exerted on operating cable 30 by the windup spring 72 of the operating cable length compensating mechanism 34. Safety stop 152 is rotatably mounted in housing 118 so that dog 172 thereof may be rotated into and out of engagement with actuating lever 144. An inspection cover, designated 173, is provided in housing 118 and secured thereto by screw 175 for the purpose of exposing the end of operating cable 30.

Fluid connector 124 is threadably engaged with bore 130 of housing 118 by means of male-female threads 174 and is provided at its forward end with a control valve retainer, designated 176. The fluid connector is also provided with a fluid passage therethrough for delivering the high pressure fluid to be sprayed from the hose, designated 178, to the control valve 120. A suitable hose connection, designated 180, is provided for coupling hose 178 to connector 124. Control valve 120 is inserted in bore 126 of housing 118 and is engaged by retainer 176 of connector 124 as the connector is threaded into its bore 130 to thereby retain and locate control valve 120 within housing 118. For convenience sake, hose clamps, designated 182, are provided along the length of telescoping pole 14 and handle portion 12 in order to keep hose 178 from hanging loosely from its connection to fluid connector 124. A bracket, designated 184, may also be provided on handle portion 12 for supporting a hose clamp.

In operating extendable spray gun 10, the operator first adjusts control valve 120 to the desired maximum spray to be emitted from spray opening 142 as fully described in my co-pending application Ser. No. 254,376 now U.S. Pat. No. 4,389,017, above referred to. Next, the operator extends the telescopic pole 14 to the desired operating length and clamps the various pole sections 114 in place by tightening pole clamps 116. By so extending telescopic pole 14, operating cable 30, being attached at its extreme end to control valve operating linkage 122 of spray head portion 16, is un-wound from cable spool 32 and is placed under tension by windup spring 72 of operating cable length compensating mechanism 34. Since actuating lever biasing spring 148 has a greater spring force than that of windup spring 72, control valve operating linkage 122 remains unaffected by the tension exerted by operating cable 30. The operator is now ready to commence spray painting out-of-reach surfaces with extendable spray gun 10 and can safely disengage safety stop 152 from engagement with activating lever 144 of operating linkage 122.

The operator then grasps handle 18 of handle portion 12 with fingers extended around handle lever 48. By so grasping handle 18, handle lever 48 is pivotally moved about retaining pin 56 so that lever arm 50 is pivotally moved against arm 66 of pivot lever 52 thereby rotating pivot lever 52 about pivot pin 70 and causing arm 68 of pivot lever 52 to be moved against trigger 26. The force of arm 68 against trigger 26 causes the trigger to be moved on pin 36 against the biasing action of spring 54 and result in engagement of pinion gear segment 38 with spur gear 44 of cable spool 32. Thus positioned, triggering of the spray gun can be accomplished. As the operator depresses trigger 26, spur gear 44 is rotated about its axis by pinion gear segment 38 thus revolving cable spool 32 and taking up on operating cable 30. Of course, sufficient force must be exerted on trigger 26 by the operator to overcome the spring force of actuating lever biasing spring 148 and valve spring 141 located in control valve 120. The axial movement of operating cable 30 imparted thereto by the depression of trigger 26, is transmitted via control valve operating linkage 122 to valve stem assembly 136 to thereby retract valve stem 138 against the biasing action of the valve spring. This retraction of valve stem 138 opens spray opening 142 thereby releasing the high pressure paint delivered thereto via hose 178 and fluid connector 124 resulting in a spray suitable for painting.

In the event the operator wishes to spray paint without utilizing the telescopic pole 14, it is possible to remove a part of spray head portion 16 from the extendable spray gun 10 to be used as a hand held unit for spraying. In order to accomplish this, the operator removes pivot pin 154 which retains actuating lever 144 and removes lever 144 disengaging it from the remainder of operating linkage 122. He then uncouples spray head housing 118 from pole coupling 125 by unclamping axially clampable bore 128 and replaces actuating lever 144 and pin 154. Thus removes, this part of the spray head may be utilized as a hand held spraying unit.

It is to be understood that the foregoing general and detailed descriptions are explanatory of the present invention and are not to be interpreted as restrictive of the scope of the following claims.

What is claimed is:

1. An extendable spray gun for hydraulically atomizing and spraying liquids, which includes:

(a) a telescopically extendable pole having first and second ends;

(b) means for adjustably securing the length of said pole;

(c) a handle portion included at the first end of said pole;

(d) a spray head having a control valve included at the second end of said pole;

(e) conduit means connected to said spray head communicating with a source of liquid under pressure;

(f) trigger means included in said handle portion for directly actuating said control valve; and (g) means included in said trigger means for compensating for changes in the length of said telescoping pole whereby direct actuation of said control valve by said trigger means is unaffected by changes in the length of said telescoping pole.

2. An extendable spray gun as defined in claim 1 which further comprises means included in said trigger means for disengaging said trigger means from the actuation of said control valve when said handle portion is not grasped by a spray gun operator.

3. An extendable spray gun as defined in claim 1 wherein the trigger means includes an operating cable extending the length of said pole between said trigger means and said control valve.

4. An extendable spray gun as defined in claim 3 wherein said compensating means includes a cable spool on which the excess of said operating cable is wound, tensioning means acting on said cable spool for maintaining tension on said operating cable without regard to the length thereof, biasing means in said spray head portion for biasing said control valve to a normally closed position, and means included in said trigger means for segmentally taking up on said operating cable thereby actuating said control valve.

5. An extendable spray gun as defined in claim 4 wherein the means for segmentally taking up on said operating cable includes a rotatable circular gear axially fixedly mounted on said cable spool and a gear segment operatively engaged with said circular gear and connected to a trigger in said trigger means.

6. An extendable spray gun as defined in claim 5 wherein said trigger means includes biasing means for biasing said gear segment connected to said trigger normally out of engagement with the circular gear of said cable spool and means included in said handle portion to counter said biasing means and cause the engagement of said gears when said handle portion is grasped by a spray gun operator.

7. An extendable spray gun as defined in claim 6 wherein said counter biasing means includes a handle lever which is grasped by the operator when grasping the handle portion and a further lever to transfer the motion of said handle lever when grasped to said gear segment of said trigger to counter the biasing action of said biasing means to thereby engage said gear segment with said circular gear of said cable spool.

8. An extendable spray gun as defined in claim 4 wherein the tensioning means include a windup spring operatively engaging said cable spool by means of a spring hook rotatably driven by and communicating with said cable spool.

9. An extendable spray gun as defined in claim 8 wherein the tensioning means further includes a gear train disposed between said cable spool and said spring hook which reduces the rotational movement of said spring hook from the rotational movement of said cable spool.

10. An extendable spray gun as defined in claim 1 wherein said spray head includes a fluid bore communicating with said conduit means and terminating in a spray opening and said control valve includes a valve bore substantially transverse to said fluid bore having a retractable valve stem therein which is actuated to open and close said fluid bore by said trigger means.

11. An extendable spray gun as defined in claim 10 wherein said spray head further includes a biasing means for biasing said retractable valve stem to normally close said fluid bore.

12. An extendable spray gun as defined in claim 11 wherein said valve bore intersects said fluid bore adjacent said spray opening such that said valve stem, when retracted, forms a part of said spray opening.

13. An extendable spray gun as defined in claim 1 wherein said spray head is detachable from said extendable spray gun and the trigger means thereof whereby said spray head may be used separately therefrom as a spray unit.

14. An extendable spray gun as defined in claim 13 wherein said control valve includes an actuating lever for the actuation thereof which is detachably engaged with said trigger means in said handle portion.

15. An extendable spray gun for hydraulically atomizing and spraying liquids, which includes:

(a) a telescopically extendable pole having first and second ends;
(b) means for adjustably securing the length of said pole;
(c) a handle portion included at the first end of said pole;
(d) a detachable spray head rotatably mounted at the second end of said pole;
(e) conduit means connected to said spray head communicating with a source of liquid under pressure;
(f) a control valve in said spray head having an actuating arm for the actuation thereof;
(g) an operating cable extending between said handle portion and said spray head and operatively communicating with the actuating arm of said control valve;
(h) means for changing the length of said operating cable to correspond with the length of said telescopically extendable pole;
(i) trigger means in said handle portion operatively engageable with said operating cable to segmentally take up on said cable and thereby actuate said control valve; and
(j) means included in said trigger means for disengaging said trigger means from said operative engagement with said operating cable when said handle portion is not grasped by a spray gun operator.

16. An extendable spray gun as defined in claim 15 wherein the means for changing the length of said operating cable includes a cable spool on which the excess of said operating cable is wound, tensioning means acting on said cable spool for maintaining tension on said operating cable as said cable is taken up or unwound from said cable spool, and biasing means in said spray head normally biasing said control valve to a closed position and exerting an opposing tension on said operating cable greater than that of said tensioning means.

* * * * *